US010770050B2

(12) United States Patent
Zhu et al.

(10) Patent No.: US 10,770,050 B2
(45) Date of Patent: Sep. 8, 2020

(54) AUDIO DATA PROCESSING METHOD AND APPARATUS

(71) Applicant: TENCENT TECHNOLOGY (SHENZHEN) COMPANY LIMITED, Shenzhen, Guangdong (CN)

(72) Inventors: Bi Lei Zhu, Shenzhen (CN); Ke Li, Shenzhen (CN); Yong Jian Wu, Shenzhen (CN); Fei Yue Huang, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 179 days.

(21) Appl. No.: 15/775,460

(22) PCT Filed: Jun. 2, 2017

(86) PCT No.: PCT/CN2017/086949
§ 371 (c)(1),
(2) Date: May 11, 2018

(87) PCT Pub. No.: WO2018/001039
PCT Pub. Date: Jan. 4, 2018

(65) Prior Publication Data

US 2018/0330707 A1 Nov. 15, 2018

(30) Foreign Application Priority Data

Jul. 1, 2016 (CN) ..... 2016 1 0518086

(51) Int. Cl.
*G10H 1/36* (2006.01)
*G10L 21/0272* (2013.01)

(52) U.S. Cl.
CPC ..... *G10H 1/366* (2013.01); *G10H 2210/005* (2013.01); *G10H 2210/056* (2013.01);
(Continued)

(58) Field of Classification Search
CPC ..... G10H 1/366; G10H 2210/005; G10H 2210/056; G10H 2210/066; G10H 2250/031; G10H 2250/215
(Continued)

(56) References Cited

U.S. PATENT DOCUMENTS 8,626,495 B2 * 1/2014 Boldt ..... H04R 25/505 704/200
2011/0058685 A1 * 3/2011 Sagayama ..... G10L 21/0272 381/98
(Continued)

FOREIGN PATENT DOCUMENTS

CN 101944355 A 1/2011
CN 103680517 A 3/2014
(Continued)

OTHER PUBLICATIONS

Dan Barry, Sound Sourec Separation: Azimuth Discrimination and Resynthesis, Jan. 1, 2004, Technological University of Dublin, https://arrow.tudublin.ie/cgi/viewcontent.cgi?article=1026&context=argcon (Year: 2004).*
(Continued)

*Primary Examiner* — David S Warren
*Assistant Examiner* — Christina M Schreiber
(74) *Attorney, Agent, or Firm* — Sughrue Mion, PLLC

(57) ABSTRACT

An audio data processing method and apparatus are provided. The method includes obtaining audio data. An overall spectrum of the audio data is obtained and separated into a singing voice spectrum and an accompaniment spectrum. An accompaniment binary mask of the audio data is calculated according to the audio data. The singing voice spectrum and the accompaniment spectrum are processed using the accompaniment binary mask, to obtain accompaniment data and singing voice data.

17 Claims, 9 Drawing Sheets

(52) U.S. Cl.
CPC . *G10H 2210/066* (2013.01); *G10H 2250/031* (2013.01); *G10H 2250/215* (2013.01); *G10L 21/0272* (2013.01)

(58) Field of Classification Search
USPC ..... 84/610
See application file for complete search history.

(56) References Cited

U.S. PATENT DOCUMENTS

2013/0064379 A1* 3/2013 Pardo ..... H04S 7/40 381/56
2013/0121511 A1* 5/2013 Smaragdis ..... G10L 25/48 381/119
2014/0355776 A1* 12/2014 Park ..... G10L 21/0208 381/71.2
2015/0016614 A1* 1/2015 Buyens ..... H04S 1/005 381/27
2016/0037283 A1* 2/2016 Uhle ..... H04S 7/307 381/27
2017/0251319 A1* 8/2017 Jeong ..... G10L 21/028
2018/0075863 A1* 3/2018 Duong ..... G10L 19/20
2018/0330707 A1* 11/2018 Zhu ..... G10H 1/366
2018/0349493 A1* 12/2018 Zhao ..... G06F 16/685
2019/0130582 A1* 5/2019 Cheng ..... G06T 7/248
2020/0042879 A1* 2/2020 Jansson ..... G10H 1/0008

FOREIGN PATENT DOCUMENTS

CN 103943113 A 7/2014
CN 104616663 A * 5/2015 ..... G10L 25/81
CN 104616663 A 5/2015
CN 106024005 A 10/2016

OTHER PUBLICATIONS

Jonathan P. Forsyth, Source Separation, Removal, and Resynthesis Using Azimuth-based Source Separation, Aug. 8, 2008, Department of Music and Performing Arts Professions in the Steinhardt School, https://pdfs.semanticscholar.org/dbab/5ee79ee8b9 (Year: 2008).*
International Search Report of PCT/CN2017/086949 dated Aug. 18, 2017.

* cited by examiner

AUDIO DATA PROCESSING METHOD AND APPARATUS

CROSS-REFERENCE TO RELATED APPLICATIONS

This application is a National Stage entry of International Patent Application No. PCT/CN2017/086949, filed Jun. 2, 2017, which claims priority from Chinese Patent Application No. 201610518086.6, entitled "AUDIO DATA PROCESSING METHOD AND APPARATUS" filed with the Chinese Patent Office on Jul. 1, 2016, the entire contents of which are incorporated by reference herein in their entirety.

BACKGROUND

1. Field

This application relates to the field of computer technologies, and in particular, to an audio data processing method and apparatus.

2. Description of the Related Art

A karaoke system is a combination of a music player and recording software. During use of the karaoke system, an accompaniment to a song may be played independently, and additionally a singing voice of a user may be synthesized into the accompaniment to the song, and audio effect processing may be performed on the singing voice of the user, and so on. Usually, the karaoke system includes a song library and an accompaniment library. In the related art, the accompaniment library mainly includes an original accompaniment, and the original accompaniment needs to be recorded by professionals. As a result, the recording efficiency is low, and this does not facilitate mass production.

SUMMARY

According to an aspect of one or more embodiments, there is provided a method. The method includes obtaining audio data. An overall spectrum of the audio data is obtained and separated into a singing voice spectrum and an accompaniment spectrum. An accompaniment binary mask of the audio data is calculated according to the audio data. The singing voice spectrum and the accompaniment spectrum are processed using the accompaniment binary mask, to obtain accompaniment data and singing voice data.

According to other aspects of one or more embodiments, there are provided an apparatus and another method consistent with the above method.

BRIEF DESCRIPTION OF THE DRAWINGS

Exemplary embodiments will be described below with reference to the accompanying drawings, in which.

DETAILED DESCRIPTION

The following clearly and completely describes the technical solutions in the embodiments of this application with reference to the accompanying drawings in the embodiments of this application. The described embodiments are merely a part rather than all of the embodiments of this application. All other embodiments obtained by a person skilled in the art based on the embodiments of this application without creative efforts shall fall within the protection scope of this application and the appended claims.

To implement mass production of accompaniment, an inventor of this application considers that a voice removal method may be used. Mainly, an Azimuth Discrimination and Resynthesis (ADRess) method may be used to perform voice removal processing on a batch of songs, to improve the accompaniment production efficiency. In the related art, this processing method is mainly implemented based on a similarity between strengths of a voice on left and right channels and a similarity between strengths of a sound of an instrument on left and right channels. For example, the strengths of the voice on the left and right channels are similar, and the strengths of the sound of the instrument on the left and right channels differ from each other. By means of this related art method, although a voice in a song may be removed to some extent, because strengths of sounds of some instruments such as a drum and a bass on the left and right channels are also similar, the sounds of the instruments may be removed together with the voice. Consequently, it is hard to obtain entire accompaniment, the precision is low, and the distortion degree is high.

In view of this, embodiments of this application provide an audio data processing method, apparatus, and system.

Figure 1A:
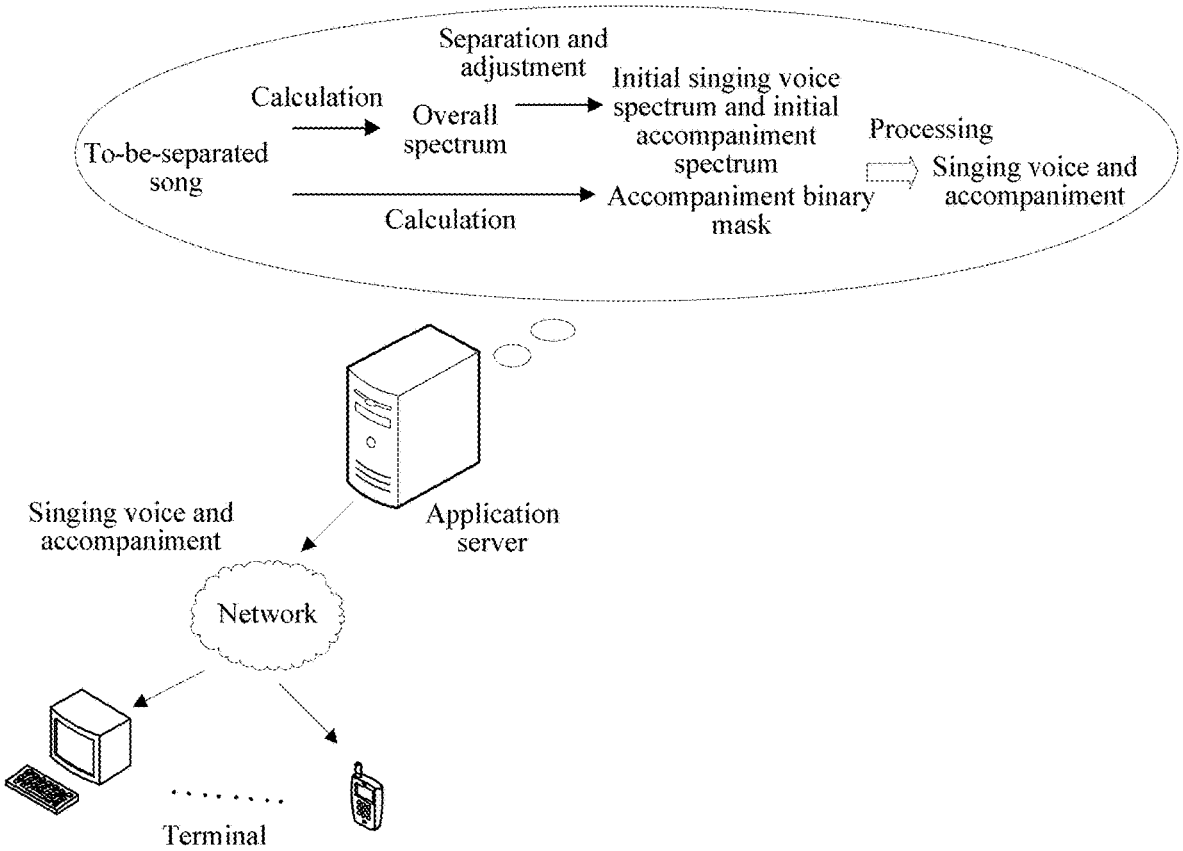
FIG. 1A is a schematic diagram of a scenario of an audio data processing system according to an embodiment of this application.

Referring to FIG. 1A, the audio data processing system may include any audio data processing apparatus provided in the embodiments of this application. The audio data processing apparatus may be specifically integrated into a server. The server may be an application server corresponding to a karaoke system, and may be configured to: obtain to-be-separated audio data; obtain an overall spectrum of the to-be-separated audio data; separate the overall spectrum, to obtain a separated singing voice spectrum and a separated accompaniment spectrum, where the singing voice spectrum includes a spectrum corresponding to a singing part of a musical composition, and the accompaniment spectrum includes a spectrum corresponding to an accompaniment part of the musical composition; adjust the overall spectrum according to the separated singing voice spectrum and the separated accompaniment spectrum, to obtain an initial singing voice spectrum and an initial accompaniment spectrum; calculate an accompaniment binary mask according to the to-be-separated audio data; and process the initial singing voice spectrum and the initial accompaniment spectrum by using the accompaniment binary mask, to obtain target accompaniment data and target singing voice data.

The to-be-separated audio data may be a song, the target accompaniment data may be accompaniment, and the target singing voice data may be a singing voice. The audio data processing system may further include a terminal, and the terminal may include a smartphone, a computer, another music playback device, or the like. When a singing voice and accompaniment need to be separated from a to-be-separated song, the application server may obtain the to-be-separated song, calculate an overall spectrum according to the to-be-separated song, and separate and adjust the overall spectrum, to obtain an initial singing voice spectrum and an initial accompaniment spectrum. Meanwhile, the application server calculates an accompaniment binary mask according to the to-be-separated song, and processes the initial singing voice spectrum and the initial accompaniment spectrum by using the accompaniment binary mask, to obtain a singing voice and accompaniment. Subsequently, a user may obtain a singing voice or accompaniment from the application server by means of an application or a web page screen in the terminal when connecting to a network.

It may be understood that in the foregoing method, an objective of performing the step of "adjusting the overall spectrum according to the separated singing voice spectrum and the separated accompaniment spectrum, to obtain an initial singing voice spectrum and an initial accompaniment spectrum" is to ensure that an output signal has a better dual channel effect. Actually, for an objective: separating entire accompaniment from a song, this step may be omitted. That is, in the following Embodiment 1, S104 may be omitted in some embodiments. In this way, a process of performing the step of "processing the initial singing voice spectrum and the initial accompaniment spectrum by using the accompaniment binary mask" is "processing the separated singing voice spectrum and the separated accompaniment spectrum by using the accompaniment binary mask". That is, in S106 in the following Embodiment 1, the separated singing voice spectrum and the separated accompaniment spectrum may be directly processed by using the accompaniment binary mask. Similarly, an adjustment module 40 in the following Embodiment 3 may be omitted. When the audio data processing apparatus does not include the adjustment module 40, a processing module 60 directly processes the separated singing voice spectrum and the separated accompaniment spectrum by using the accompaniment binary mask.

The following separately gives a detailed description. It should be noted that sequence numbers of the following embodiments do not indicate a sequence of priorities of the embodiments.

Embodiment 1

This embodiment is described from the perspective of an audio data processing apparatus, and the audio data processing apparatus may be integrated into a server.

Figure 1B:
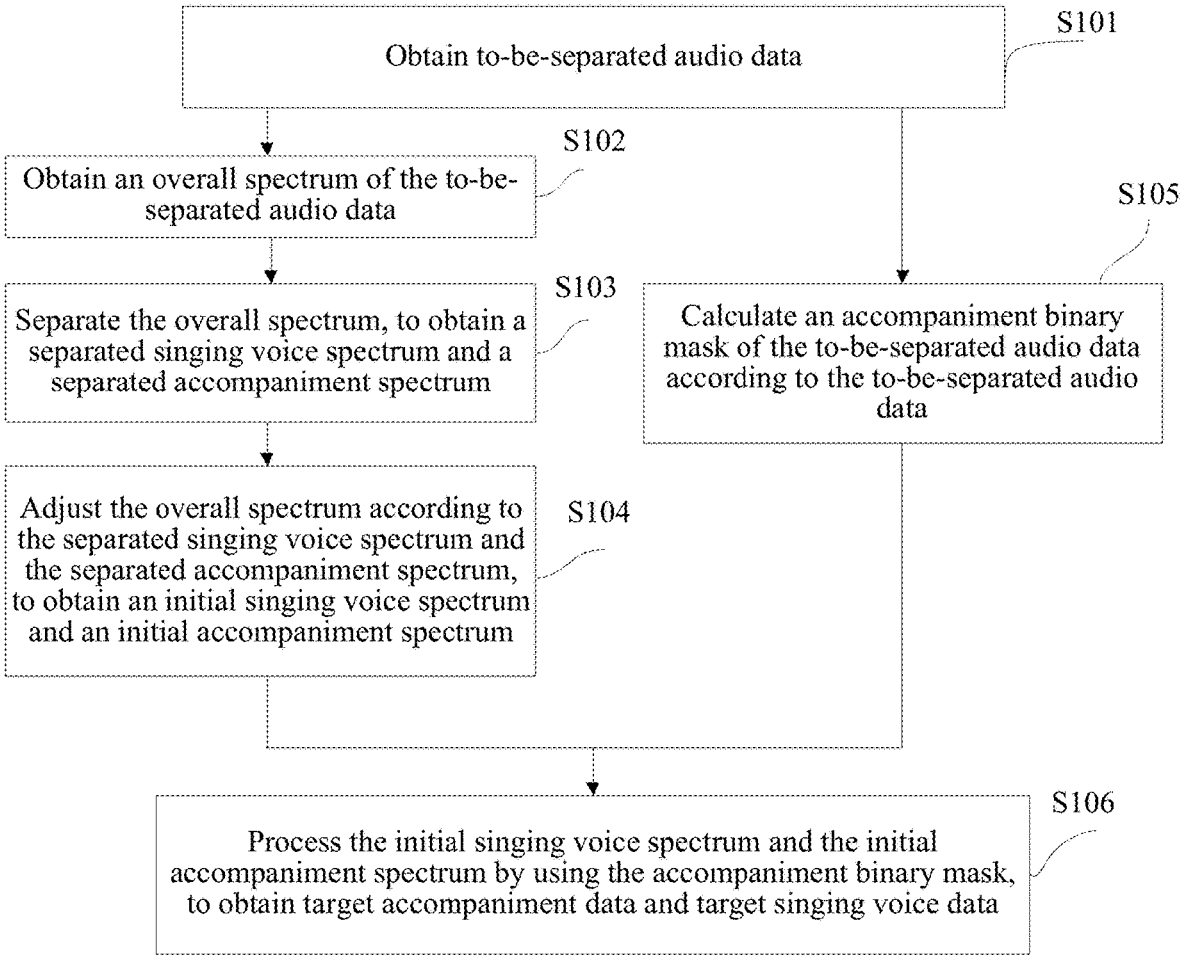
FIG. 1B is a schematic flowchart of an audio data processing method according to an embodiment of this application.

Referring to FIG. 1B, FIG. 1B specifically describes an audio data processing method according to Embodiment 1 of this application. The audio data processing method may include the following steps.

S101. Obtain to-be-separated audio data.

In this embodiment, the to-be-separated audio data mainly includes an audio file including a voice and an accompaniment sound, for example, a song, a segment of a song, or an audio file recorded by a user, and is usually represented as a time-domain signal, for example, may be a dual-channel time-domain signal.

Specifically, when a user stores a new to-be-separated audio file in the server or when the server detects that a designated database stores a to-be-separated audio file, the to-be-separated audio file may be obtained.

S102. Obtain an overall spectrum of the to-be-separated audio data.

For example, step S102 may specifically include the following step:

performing mathematical transformation on the to-be-separated audio data, to obtain the overall spectrum.

In this embodiment, the overall spectrum may be represented as a frequency-domain signal. The mathematical transformation may be STFT. The STFT transform is related to Fourier transform, and is used to determine a frequency and a phase of a sine wave of a partial region of a time-domain signal, that is, convert a time-domain signal into a frequency-domain signal. After STFT is performed on the to-be-separated audio data, an STFT spectrum diagram is obtained. The STFT spectrum diagram is a graph formed by using the converted overall spectrum according to a voice strength characteristic.

It should be understood that because in this embodiment, the to-be-separated audio data mainly is a dual-channel time-domain signal, the converted overall spectrum should also be a dual-channel frequency-domain signal. For example, the overall spectrum may include a left-channel overall spectrum and a right-channel overall spectrum.

S103. Separate the overall spectrum, to obtain a separated singing voice spectrum and a separated accompaniment spectrum.

The singing voice spectrum includes a spectrum corresponding to a singing part of a musical composition, and the accompaniment spectrum includes a spectrum corresponding to an accompaniment part of the musical composition. It may also be understood that accompaniment is a music part that mainly provides rhythm and/or harmonic supports for a song, melody of an instrument, or a main theme, and therefore, the accompaniment spectrum may be understood as a spectrum of the music part. In addition, singing is an action of producing a music sound by means of a voice, and a singer adds a daily language by using a continuous tone and rhythm and various vocalization skills. A singing voice is a voice of singing a song, and therefore, the singing voice spectrum may be understood as a spectrum of a voice of singing a song.

Step S103 may further be described as "separating the overall spectrum, to obtain the singing voice spectrum and the accompaniment spectrum". To distinguish between the singing voice spectrum and the accompaniment spectrum and another singing voice spectrum and another accompaniment spectrum, the singing voice spectrum herein may be referred to as a first singing voice spectrum, and the accompaniment spectrum herein may be referred to as a first accompaniment spectrum.

In this embodiment, the musical composition mainly includes a song, the singing part of the musical composition mainly is a voice, and the accompaniment part of the musical composition mainly is a sound of an instrument. Specifically, the overall spectrum may be separated by using a preset algorithm. The preset algorithm may be determined according to requirements of an actual application. For example, in this embodiment, the preset algorithm may use a part of algorithm in a related art ADRess method, and may be specifically as follows:

1. It is assumed that an overall spectrum of a current frame includes a left-channel overall spectrum Lf(k) and a right-channel overall spectrum Rf(k), where k is a band index.

Azimugram of a right channel and Azimugram of a left channel are separately calculated as follows:

the Azimugram of the right channel is $AZ_R(k,i)=|Lf(k)-g(i)*Rf(k)|$; and the Azimugram of the left channel is $AZ_L(k,i)=|Rf(k)-g(i)*Lf(k)|$.

g(i) is a scale factor, g(i)=i/b, 0≤i≤b, b is an azimuth resolution, i is an index, and Azimugram represents a degree to which a frequency component in a $k^{th}$ band is cancelled under the scale factor g(i).

2. For each band, a scale factor having a highest cancellation degree is selected to adjust Azimugram:

if $AZ_R(k,i)=\min(AZ_R(k))$, $AZ_R(k,i)=\max(AZ_R(k))-\min(AZ_R(k))$;

otherwise $AZ_R(k,i)=0$; and correspondingly, a same method may be used to calculate $AZ_L(k, i)$.

3. For the adjusted Azimugram in step 2, because strengths of a voice on the left and right channels are similar, the voice is in a location in which i is relatively large in the Azimugram, that is, a location in which g(i) approaches 1. If a parameter subspace width H is given, a separated singing voice spectrum on the right channel is estimated as $$V_R(k) = \sum_{i=b-H}^{i=b} AZ_R(k, i),$$

and a separated accompaniment spectrum on the right channel is estimated as $$M_R(k) = \sum_{i=0}^{i=b-H-1} AZ_R(k, i).$$

Correspondingly, a separated singing voice spectrum $V_L(k)$ and a separated accompaniment spectrum $M_L(k)$ on the left channel may be obtained by using the same method, and details are not described herein again.

S104. Adjust the overall spectrum according to the separated singing voice spectrum and the separated accompaniment spectrum, to obtain an initial singing voice spectrum and an initial accompaniment spectrum.

In this embodiment, to ensure a dual-channel effect of a signal output by using the ADRess method, a mask further is calculated according to a separation result of the overall spectrum, and the overall spectrum is adjusted by using the mask, to obtain a final initial singing voice spectrum and initial accompaniment spectrum that have a better dual-channel effect.

To distinguish between the initial singing voice spectrum and the initial accompaniment spectrum and the first singing voice spectrum and the first accompaniment spectrum in step S103, the initial singing voice spectrum may be referred to as a second singing voice spectrum and the initial accompaniment spectrum may be referred to as a second accompaniment spectrum. In this way, step S104 may also be described as "adjusting the overall spectrum according to the first singing voice spectrum and the first accompaniment spectrum, to obtain the second singing voice spectrum and the second accompaniment spectrum".

For example, step S104 may specifically include the following step:

calculating a singing voice binary mask according to the separated singing voice spectrum and the separated accompaniment spectrum, and adjusting the overall spectrum by using the singing voice binary mask, to obtain the initial singing voice spectrum and the initial accompaniment spectrum.

In this embodiment, the overall spectrum includes a right-channel overall spectrum Rf(k) and a left-channel overall spectrum Lf(k). Because both the separated singing voice spectrum and the separated accompaniment spectrum are dual-channel frequency-domain signals, the singing voice binary mask calculated according to the separated singing voice spectrum and the separated accompaniment spectrum correspondingly includes $Mask_R(k)$ corresponding to the left channel and $Mask_L(k)$ corresponding to the right channel.

For the right channel, a method for calculating a singing voice binary mask $Mask_R(k)$ may be: if $V_R(k)\geq M_R(k)$, $Mask_R(k)=1$; or otherwise, $Mask_R(k)=0$. Subsequently. Rf(k) is adjusted, to obtain the adjusted initial singing voice spectrum $V_R(k)'=Rf(k)*Mask_R(k)$, and the adjusted initial accompaniment spectrum $M_R(k)'=Rf(k)*(1-Mask_R(k))$.

Correspondingly, for the left channel, the corresponding singing voice binary mask $Mask_L(k)$, the initial singing voice spectrum $V_L(k)'$, and the initial accompaniment spectrum $M_L(k)'$ may be obtained by using the same method, and details are not described herein again.

Figure 1C:
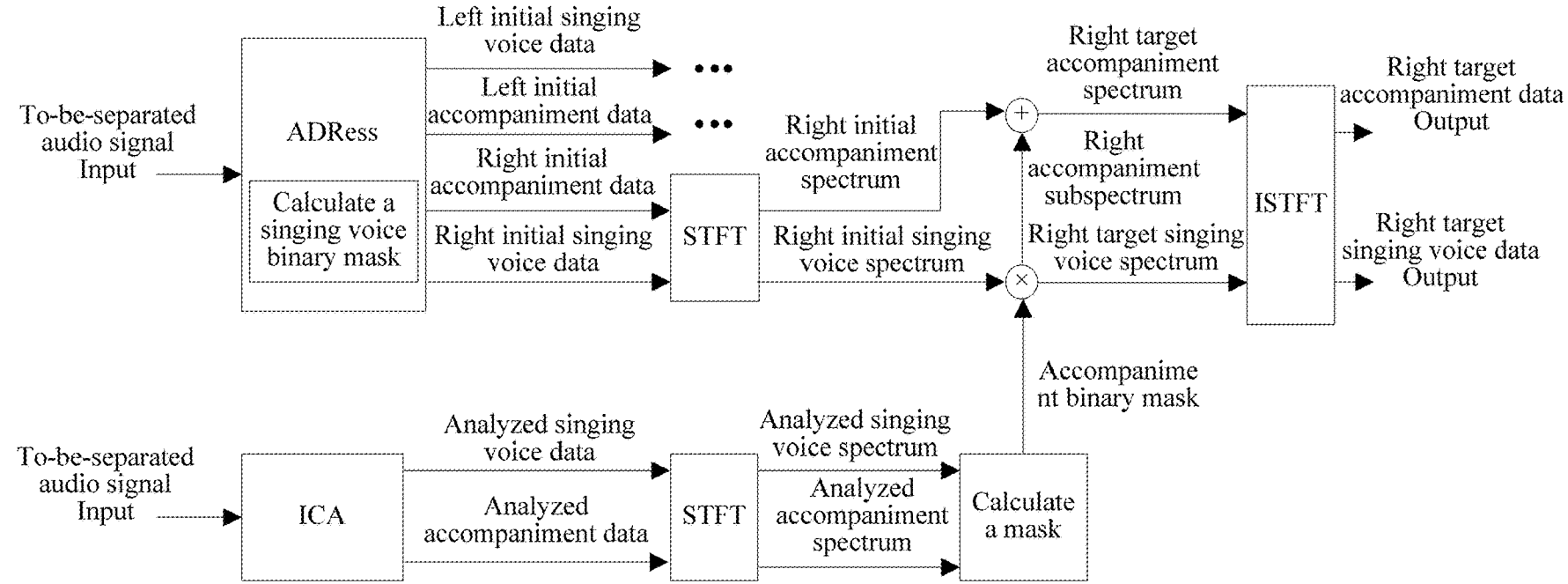
FIG. 1C is a system frame diagram of an audio data processing method according to an embodiment of this application.

It should be supplemented that because when a related art ADRess method is used for processing, an output signal is a time-domain signal, a related art ADRess system frame is used. Inverse short-time Fourier transform (ISTFT) may be performed on the adjusted overall spectrum after the step of "adjusting the overall spectrum by using the singing voice binary mask", to output initial singing voice data and initial accompaniment data. That is, a whole process of the related art ADRess method is completed. Subsequently, STFT transform may be performed on the initial singing voice data and the initial accompaniment data that are obtained after the transform, to obtain the initial singing voice spectrum and the initial accompaniment spectrum. For a specific system frame, refer to FIG. 1C. It should be noted that in FIG. 1C, related processing on the initial singing voice data and the initial accompaniment data on the left channel are ignored. For the related processing, refer to the step of processing the initial singing voice data and the initial accompaniment data on the right channel.

S105. Calculate an accompaniment binary mask of the to-be-separated audio data according to the to-be-separated audio data.

For example, step S105 may specifically include the following steps.

(11). Perform independent component analysis (ICA) on the to-be-separated audio data, to obtain analyzed singing voice data and analyzed accompaniment data.

To distinguish between the analyzed singing voice data and the analyzed accompaniment data and other data, the analyzed singing voice data may be referred to as first singing voice data, and the analyzed accompaniment data may be referred to as first accompaniment data. Therefore, the step may be described as "performing ICA on the to-be-separated audio data, to obtain the first singing voice data and the first accompaniment data".

In this embodiment, an ICA method is a method for studying blind source separation (BSS). In this method, the to-be-separated audio data (which mainly is a dual-channel time-domain signal) may be separated into an independent singing voice signal and an independent accompaniment signal, and an assumption is that components in a hybrid signal are non-Gaussian signals and independent statistics collection is performed on the components. A calculation formula may be approximately as follows:

$$U=Was.$$

Where s denotes the to-be-separated audio data, A denotes a hybrid matrix, W denotes an inverse matrix of A, the output signal U includes $U_1$ and $U_2$, $U_1$ denotes the analyzed singing voice data, and $U_2$ denotes the analyzed accompaniment data.

It should be noted that because the signal U output by using the ICA method are two unordered mono time-domain signals, and it is not clarified which signal is $U_1$ and which signal is $U_2$, relevance analysis may be performed on the output signal U and an original signal (that is, the to-be-separated audio data), a signal having a high relevance coefficient is used as $U_1$, and a signal having a low relevance coefficient is used as $U_2$.

(12) Calculate the accompaniment binary mask according to the analyzed singing voice data and the analyzed accompaniment data. That is, the accompaniment binary mask is calculated according to the first singing voice data and the first accompaniment data.

For example, step (12) may specifically include the following steps.

Perform mathematical transformation on the analyzed singing voice data and the analyzed accompaniment data, to obtain a corresponding analyzed singing voice spectrum and analyzed accompaniment spectrum.

To distinguish between the corresponding singing voice spectrum and accompaniment spectrum and other spectra, the analyzed singing voice spectrum may be referred to as a fourth singing voice spectrum, and the analyzed accompaniment spectrum may be referred to as a fourth accompaniment spectrum. Therefore, this step may be described as "performing mathematical transformation on the first singing voice data and the first accompaniment data, to obtain the corresponding fourth singing voice spectrum and fourth accompaniment spectrum".

(12) Calculate the accompaniment binary mask according to the analyzed singing voice spectrum and the analyzed accompaniment spectrum. That is, the accompaniment binary mask is calculated according to the fourth singing voice spectrum and the fourth accompaniment spectrum.

In this embodiment, the mathematical transformation may be STFT transform, and is used to convert a time-domain signal into a frequency-domain signal. It is easily understood that because both the analyzed singing voice data and the analyzed accompaniment data that are output by using the ICA method are mono time-domain signals, there is only one accompaniment binary mask calculated according to the analyzed singing voice data and the analyzed accompaniment data, and the accompaniment binary mask may be applied to the left channel and the right channel at the same time.

There may be a plurality of manners of "calculating the accompaniment binary mask according to the analyzed singing voice spectrum and the analyzed accompaniment spectrum". For example, the manners may specifically include the following steps:

performing a comparison analysis on the analyzed singing voice spectrum and the analyzed accompaniment spectrum, and obtaining a comparison result; and calculating the accompaniment binary mask according to the comparison result.

In this embodiment, the method for calculating the accompaniment binary mask is similar to the method for calculating the singing voice binary mask in step S104. Specifically, assuming that the analyzed singing voice spectrum is $V_U(k)$, the analyzed accompaniment spectrum is $M_U(k)$, and the accompaniment binary mask is $Mask_U(k)$, the method for calculating $Mask_U(k)$ may be:

$$\text{if } M_U(k) \geq V_U(k),\ Mask_U(k)=1;\ \text{or if } M_U(k)<V_U(k),\ Mask_U(k)=0.$$

S106. Process the initial singing voice spectrum and the initial accompaniment spectrum by using the accompaniment binary mask, to obtain target accompaniment data and target singing voice data.

The target accompaniment data may be referred to as second accompaniment data, and the target singing voice data may be referred to as second singing voice data. That is, the second singing voice spectrum and the second accompaniment spectrum are processed by using the accompaniment binary mask, to obtain the second accompaniment data and the second singing voice data.

For example, step S106 may specifically include the following steps.

(21). Filter the initial singing voice spectrum by using the accompaniment binary mask, to obtain a target singing voice spectrum and an accompaniment subspectrum.

The target singing voice spectrum may be referred to as a third singing voice spectrum. Therefore, this step may also be described as "filtering the second singing voice spectrum by using the accompaniment binary mask, to obtain the third singing voice spectrum and the accompaniment subspectrum".

In this embodiment, because the initial singing voice spectrum is a dual-channel frequency-domain signal, that is, includes an initial singing voice spectrum $V_R(k)'$ corresponding to the right channel and an initial singing voice spectrum $V_L(k)'$ corresponding to the left channel, if the accompaniment binary mask $Mask_U(k)$ is imposed to the initial singing voice spectrum, the obtained target singing voice spectrum and the obtained accompaniment subspectrum should also be dual-channel frequency-domain signals.

It may be understood that the accompaniment subspectrum actually is an accompaniment component mingled with the initial singing voice spectrum.

For example, using the right channel as an example, step (21) may specifically include the following steps:

multiplying the initial singing voice spectrum by the accompaniment binary mask, to obtain the accompaniment subspectrum; and subtracting the accompaniment subspectrum from the initial singing voice spectrum, to obtain the target singing voice spectrum.

In this embodiment, assuming that an accompaniment subspectrum corresponding to the right channel is $M_{R1}(k)$, and a target singing voice spectrum corresponding to the right channel is $V_{Rtarget}(k)$, $M_{R1}(k)=V_R(k)'*Mask_U(k)$, that is. $M_{R1}(k)=Rf(k)*Mask_R(k)*Mask_U(k)$, and $V_{Rtarget}(k)=V_R(k)'-M_{R1}(k)=Rf(k)*Mask_R(k)*(1-Mask_U(k))$.

(22). Perform calculation by using the accompaniment subspectrum and the initial accompaniment spectrum, to obtain a target accompaniment spectrum.

The target accompaniment spectrum may be referred to as a third accompaniment spectrum. Therefore, this step may also be described as "performing calculation by using the accompaniment subspectrum and the second accompaniment spectrum, to obtain the third accompaniment spectrum".

For example, using the right channel as an example, step (22) may specifically include the following steps:

adding the accompaniment subspectrum and the initial accompaniment spectrum, to obtain the target accompaniment spectrum.

In this embodiment, assuming that a target accompaniment spectrum corresponding to the right channel is $M_{Rtarget}(k)$, $M_{Rtarget}(k)=M_R(k)'+M_{R1}(k)=Rf(k)*(1-Mask_R(k))+Rf(k)*Mask_R(k)*Mask_U(k)$.

In addition, it should be emphasized that step (21) and step (22) describe only related calculation using the right channel as an example. Similarly, step (21) and step (22) are also applicable to related calculation for the left channel, and details are not described herein again.

(23) Perform mathematical transformation on the target singing voice spectrum and the target accompaniment spectrum, to obtain the corresponding target accompaniment data and target singing voice data. That is, mathematical transformation is performed on the third singing voice spectrum and the third accompaniment spectrum, to obtain the corresponding accompaniment data and singing voice data. The accompaniment data herein may also be referred to as second accompaniment data, and the singing voice data may also be referred to as second singing voice data.

In this embodiment, the mathematical transformation may be ISTFT transform, and is used to convert a frequency-domain signal into a time-domain signal. In some embodiments, after obtaining dual-channel target accompaniment data and target singing voice data, the server may further process the target accompaniment data and the target singing voice data, for example, may deliver the target accompaniment data and the target singing voice data to a network server bound to the server, and a user may obtain the target accompaniment data and the target singing voice data from the network server by using an application installed in or a web page screen in a terminal device.

As may be learned from the above, in the audio data processing method provided in this embodiment, the to-be-separated audio data is obtained, the overall spectrum of the to-be-separated audio data is obtained, the overall spectrum is separated to obtain the separated singing voice spectrum and the separated accompaniment spectrum, and the overall spectrum is adjusted according to the separated singing voice spectrum and the separated accompaniment spectrum, to obtain the initial singing voice spectrum and the initial accompaniment spectrum. Meanwhile, the accompaniment binary mask is calculated according to the to-be-separated audio data, and finally, the initial singing voice spectrum and the initial accompaniment spectrum are processed by using the accompaniment binary mask, to obtain the target accompaniment data and the target singing voice data. Because in this solution, after the initial singing voice spectrum and the initial accompaniment spectrum are obtained according to the to-be-separated audio data, the initial singing voice spectrum and the initial accompaniment spectrum may further be adjusted according to the accompaniment binary mask, an accompaniment mingled with the singing voice spectrum may be filtered out, and further, the accompaniment and the initial accompaniment spectrum are synthesized into an entire accompaniment, greatly improving the separation accuracy. Therefore, an accompaniment and a singing voice may be separated from a song completely, so that not only the distortion degree may be reduced, but also mass production of accompaniments may be implemented, and the processing efficiency is high.

It may be understood that in other embodiments, for names of various singing voice data, accompaniment data, singing voice spectra, and accompaniment spectra, refer to this embodiment.

Embodiment 2

The following gives a detailed description by using an example according to the method described in Embodiment 1.

This embodiment is described in detail by using an example in which the audio data processing apparatus is integrated into a server, for example, the server may be an application server corresponding to a karaoke system, the to-be-separated audio data is a to-be-separated song, and the to-be-separated song is represented as a dual-channel time-domain signal.

Figure 2A:
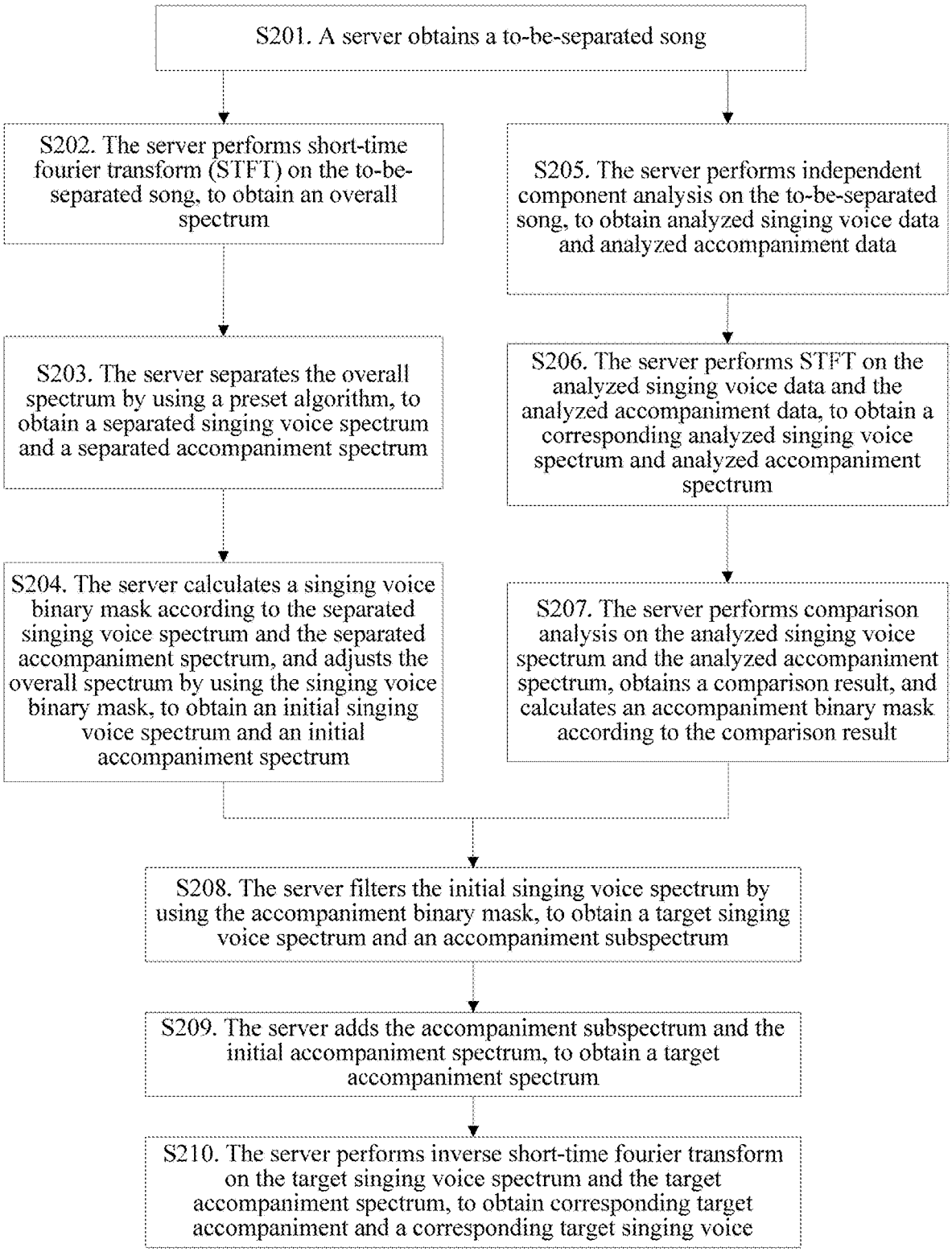
FIG. 2A is a schematic flowchart of a song processing method according to an embodiment of this application.
Figure 2B:
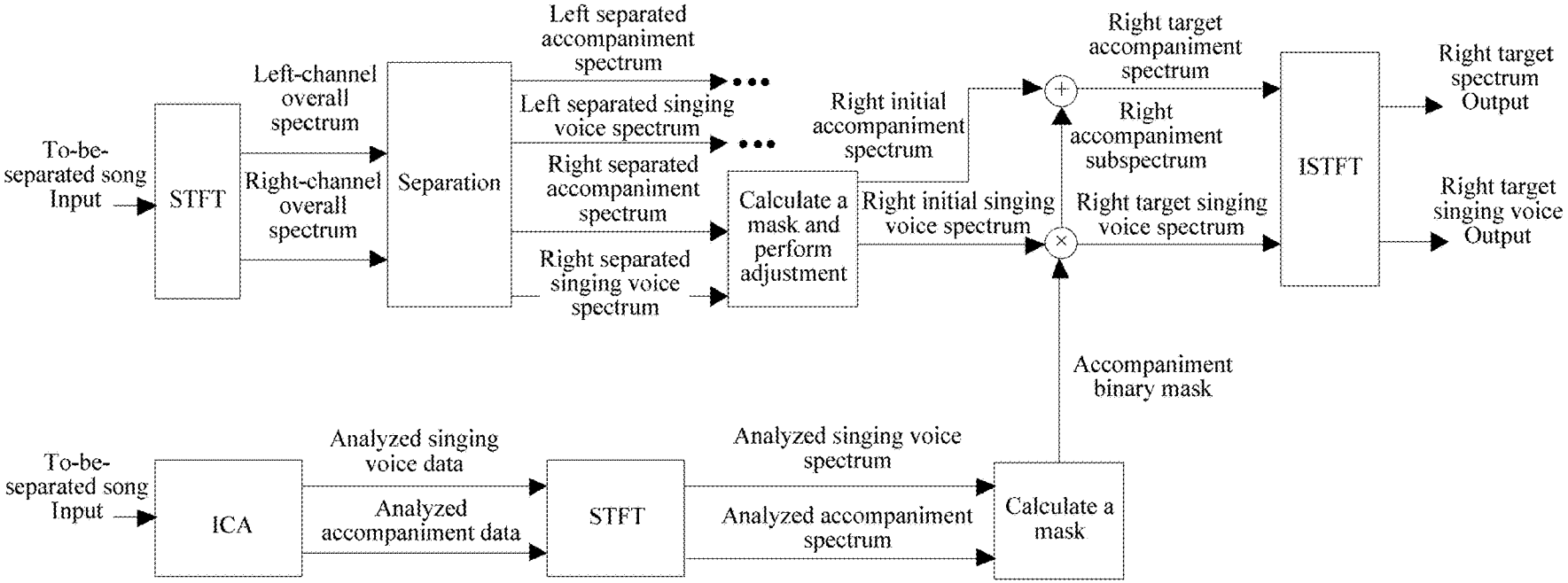
FIG. 2B is a system frame diagram of a song processing method according to an embodiment of this application.

As shown in FIG. 2A and FIG. 2B, a song processing method may specifically include the following process.

S201. The server obtains the to-be-separated song.

For example, when a user stores a to-be-separated song in the server, or when the server detects that a designated database stores a to-be-separated song, the to-be-separated song may be obtained.

S202. The server performs STFT on the to-be-separated song, to obtain an overall spectrum.

Figure 2C:
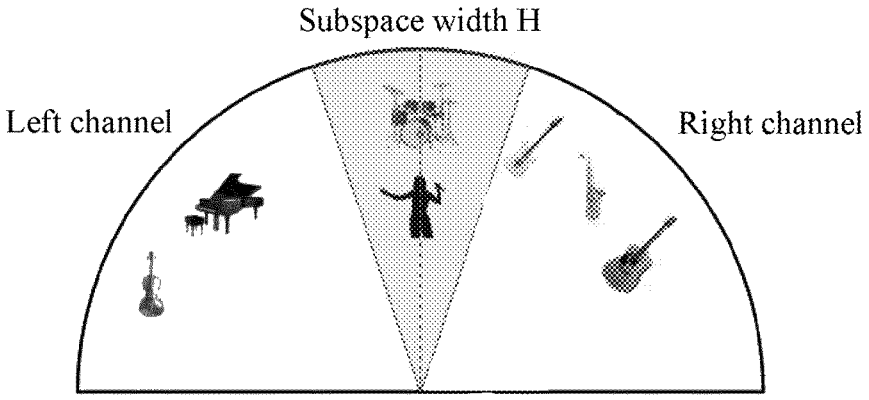
FIG. 2C is a schematic diagram of a short-time Fourier transform (STFT) spectrum according to an embodiment of this application.

For example, the to-be-separated song is a dual-channel time-domain signal, and the overall spectrum is a dual-channel frequency-domain signal, and includes a left-channel overall spectrum and a right-channel overall spectrum. Referring to FIG. 2C, if a semi-circle is used to represent an STFT spectrum diagram corresponding to the overall spectrum, a voice is usually located at a middle part of the semi-circle, and it represents that the voice has similar strengths on left and right channels. An accompaniment sound is usually located at two sides of the semi-circle, and it represents that a sound of an instrument has obviously different strengths on the two channels. In addition, if the accompaniment sound is located at the left side of the semi-circle, it represents that a strength of the sound of the instrument on a left channel is higher than a strength of the sound of the instrument on a right channel; or if the accompaniment sound is located at the right side of the semi-circle, it represents that a strength of the sound of the instrument on a right channel is higher than a strength of the sound of the instrument on a left channel.

S203. The server separates the overall spectrum by using a preset algorithm, to obtain a separated singing voice spectrum and a separated accompaniment spectrum.

For example, the preset algorithm may use a part of algorithm in a related art ADRess method, and may be specifically as follows:

1. It is assumed that a left-channel overall spectrum of a current frame is Lf(k) and a right-channel overall spectrum of the current frame is Rf(k), where k is a band index. Azimugram of the right channel and Azimugram of the left channel are separately calculated as follows:

the Azimugram of the right channel is $AZ_R(k,i)=|Lf(k)-g(i)*Rf(k)|$; and the Azimugram of the left channel is $AZ_L(k,i)=|Rf(k)-g(i)*Lf(k)|$.

g(i) is a scale factor, g(i)=i/b, 0≤i≤b, b is an azimuth resolution, i is an index, and Azimugram represents a degree to which a frequency component in a $k^{th}$ band is cancelled under the scale factor g(i).

2. For each band, a scale factor having a highest cancellation degree is selected to adjust Azimugram:

if $AZ_R(k,i)=\min(AZ_R(k))$, $AZ_R(k,i)=\max(AZ_R(k))-\min(AZ_R(k))$; or otherwise, $AZ_R(k,i)=0$; and if $AZ_L(k,i)=\min(AZ_L(k))$, $AZ_L(k,i)=\max(AZ_L(k))-\min(AZ_L(k))$; or otherwise, $AZ_L(k,i)=0$.

3. For the adjusted Azimugram in step 2, if a parameter subspace width H is given, a separated singing voice spectrum on the right channel is estimated as $$V_R(k)=\sum_{i=b-H}^{i=b} AZ_R(k,i),$$

and a separated accompaniment spectrum on the right channel is estimated as $$M_R(k)=\sum_{i=0}^{i=b-H-1} AZ_R(k,i);$$

and a separated singing voice spectrum on the left channel is estimated as $$V_L(k)=\sum_{i=b-H}^{i=b} AZ_L(k,i),$$

and a separated accompaniment spectrum on the left channel is estimated as $$M_L(k)=\sum_{i=0}^{i=b-H-1} AZ_L(k,i).$$

S204. The server calculates a singing voice binary mask according to the separated singing voice spectrum and the separated accompaniment spectrum, and adjusts the overall spectrum by using the singing voice binary mask, to obtain an initial singing voice spectrum and an initial accompaniment spectrum.

For example, for the right channel, a method for calculating a singing voice binary mask $Mask_R(k)$ may be: if $V_R(k)\geq M_R(k)$. $Mask_R(k)=1$; or otherwise. $Mask_R(k)=0$. Subsequently, the right-channel overall spectrum Rf(k) is adjusted, to obtain an adjusted initial singing voice spectrum $V_R(k)'=Rf(k)*Mask_R(k)$, and an adjusted initial accompaniment spectrum $M_R(k)'=Rf(k)*(1-Mask_R(k))$.

For the left channel, a method for calculating a singing voice binary mask $Mask_L(k)$ may be: if $V_L(k)\geq M_L(k)$, $Mask_L(k)=1$: or otherwise, $Mask_L(k)=0$. Subsequently, the left-channel overall spectrum Lf(k) is adjusted, to obtain the adjusted initial singing voice spectrum $V_L(k)'=Lf(k)*Mask_L(k)$, and the adjusted initial accompaniment spectrum $M_L(k)'=Lf(k)*(1-Mask_L(k))$.

S205. The server performs ICA on the to-be-separated song, to obtain analyzed singing voice data and analyzed accompaniment data.

For example, a calculation formula of the ICA may be approximately as follows:

$$U=Was.$$

where s denotes the to-be-separated song, A denotes a hybrid matrix, W denotes an inverse matrix of A, the output signal U includes $U_1$ and $U_2$, $U_1$ denotes the analyzed singing voice data, and $U_2$ denotes the analyzed accompaniment data.

It should be noted that because the signal U output by using the ICA method are two unordered mono time-domain signals, and it is not clarified which signal is $U_1$ and which signal is $U_2$, relevance analysis may be performed on the output signal U and an original signal (that is, the to-be-separated song), a signal having a high relevance coefficient is used as $U_1$, and a signal having a low relevance coefficient is used as $U_2$.

S206. The server performs STFT on the analyzed singing voice data and the analyzed accompaniment data, to obtain a corresponding analyzed singing voice spectrum and analyzed accompaniment spectrum.

For example, the server correspondingly obtains the analyzed singing voice spectrum $V_U(k)$ and the analyzed accompaniment spectrum $M_U(k)$ after separately performing STFT processing on the output signals $U_1$ and $U_2$.

S207. The server performs comparison analysis on the analyzed singing voice spectrum and the analyzed accompaniment spectrum, obtains a comparison result, and calculates an accompaniment binary mask according to the comparison result.

For example, assuming that the accompaniment binary mask is $Mask_U(k)$, a method for calculating $Mask_U(k)$ may be:

if $M_U(k)\geq V_U(k)$, $Mask(k)=1$; or if $M_U(k)<V_U(k)$, $Mask(k)-0$.

It should be noted that steps S202 to S204 and steps S205 to S207 may be performed at the same time, or steps S202 to S204 may be performed before steps S205 to S207, or steps S205 to S207 may be performed before steps S202 to S204. Certainly, there may be another execution sequence, and the execution sequence is not limited herein.

S208. The server filters the initial singing voice spectrum by using the accompaniment binary mask, to obtain a target singing voice spectrum and an accompaniment subspectrum.

Step S208 may specifically include the following steps:

multiplying the initial singing voice spectrum by the accompaniment binary mask, to obtain the accompaniment subspectrum; and subtracting the accompaniment subspectrum from the initial singing voice spectrum, to obtain the target singing voice spectrum.

For example, assuming that an accompaniment subspectrum corresponding to the right channel is $M_{R1}(k)$, and a target singing voice spectrum corresponding to the right channel is $V_{Rtarget}(k)$ $M_{R1}(k)=V_R(k)'*Mask_U(k)$, that is, $M_{R1}(k)=Rf(k)*Mask_R(k)*Mask_U(k)$, and $V_{Rtarget}=(k)=V_R(k)'-M_{R1}(k)=Rf(=k)*Mask_R(k)*(1-Mask_U(k))$.

Assuming that an accompaniment subspectrum corresponding to the left channel is $M_{L1}(k)$, and a target singing voice spectrum corresponding to the left channel is $V_{Ltarget}(k)$, $M_{L1}(k)=VL(k)'*Mask_U(k)$, that is, $M_{L1}(k)=Lf(k)*Mask_L(k)*Mask_U(k)$, and $V_{Ltarget}(k)=VL(k)'-M_{L1}(k)=Lf(k)*Mask_L(k)*(1-Mask_U(k))$.

S209. The server adds the accompaniment subspectrum and the initial accompaniment spectrum, to obtain a target accompaniment spectrum.

For example, assuming that a target accompaniment spectrum corresponding to the right channel is $M_{Rtarget}(k)$, $M_{Rtarget}(k)=M_R(k)'+M_{R1}(k)=Rf(k)*(1-Mask_R(k))+Rf(k)*Mask_R(k)*Mask_U(k)$.

Assuming that a target accompaniment spectrum corresponding to the left channel is $M_{Ltarget}(k)$, $M_{Ltarget}(k)=M_L(k)'+M_{L1}(k)=Lf(k)*(1-Mask_L(k))+Lf(k)*Mask_L(k)*Mask_U(k)$.

S210. The server performs ISTFT on the target singing voice spectrum and the target accompaniment spectrum, to obtain corresponding target accompaniment and a corresponding target singing voice.

For example, after the server obtains the target accompaniment and the target singing voice, a user may obtain the target accompaniment and the target singing voice from the server by using an application installed in or a web page screen in a terminal.

It should be noted that FIG. 2B ignores related processing for the separated accompaniment spectrum and the separated singing voice spectrum on the left channel, and for the related processing, refer to steps of processing the separated accompaniment spectrum and the separated singing voice spectrum on the right channel.

As may be learned from the above, in the song processing method provided in this embodiment, the server obtains the to-be-separated song, performs STFT on the to-be-separated song to obtain the overall spectrum, and separates the overall spectrum by using the preset algorithm, to obtain the separated singing voice spectrum and the separated accompaniment spectrum. Subsequently, the server calculates the singing voice binary mask according to the separated singing voice spectrum and the separated accompaniment spectrum, and adjusts the overall spectrum by using the singing voice binary mask, to obtain the initial singing voice spectrum and the initial accompaniment spectrum. Meanwhile, the server performs ICA on the to-be-separated song, to obtain the analyzed singing voice data and the analyzed accompaniment data, and performs STFT on the analyzed singing voice data and the analyzed accompaniment data, to obtain the corresponding analyzed singing voice spectrum and analyzed accompaniment spectrum. Then, the server performs comparison analysis on the analyzed singing voice spectrum and the analyzed accompaniment spectrum, obtains the comparison result, and calculates the accompaniment binary mask according to the comparison result. Finally, the server filters the initial singing voice spectrum by using the accompaniment binary mask, to obtain the target singing voice spectrum and the accompaniment subspectrum, and performs ISTFT on the target singing voice spectrum and the target accompaniment spectrum, to obtain the corresponding target accompaniment data and the corresponding target singing voice data, so that accompaniment and a singing voice may be separated from a song completely, greatly improving the separation accuracy and reducing the distortion degree. In addition, mass production of accompaniment may further be implemented, and the processing efficiency is high.

Embodiment 3

Figure 3A:
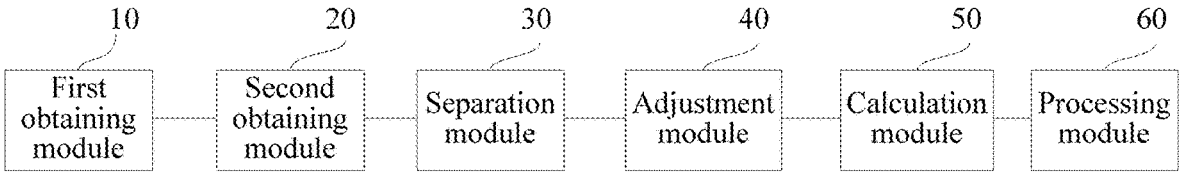
FIG. 3A is a schematic structural diagram of an audio data processing apparatus according to an embodiment of this application.
Figure 3B:
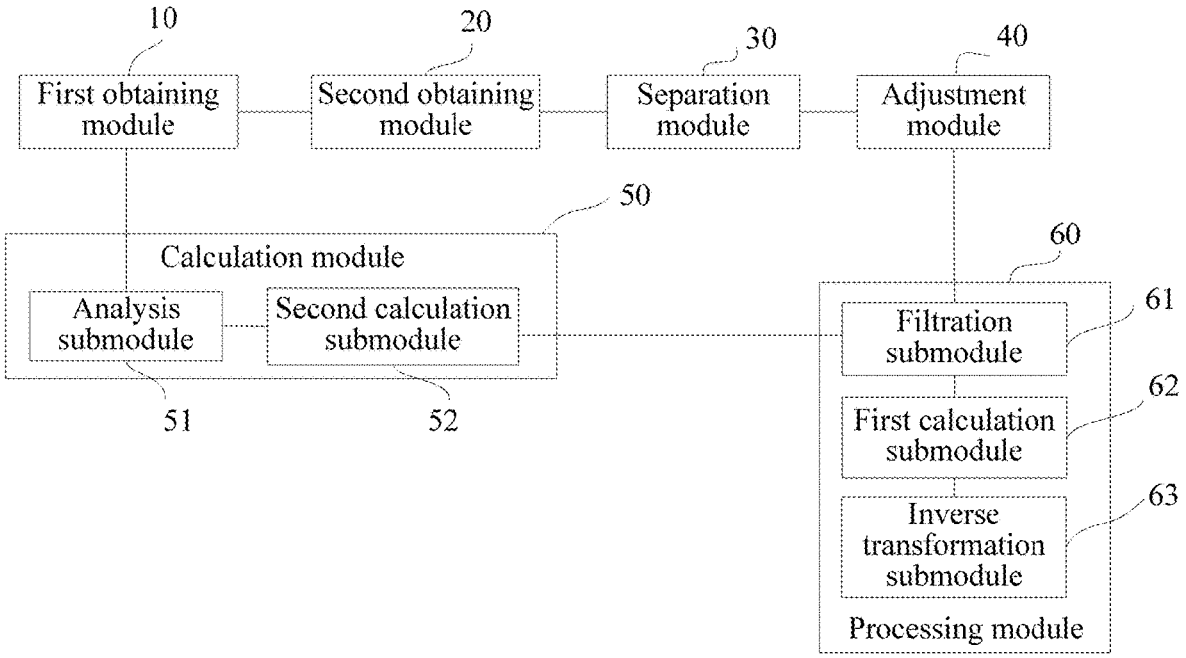
FIG. 3B is another schematic structural diagram of an audio data processing apparatus according to an embodiment of this application.

Based on the methods described in Embodiment 1 and Embodiment 2, this embodiment is further described from the perspective of an audio data processing apparatus. Referring to FIG. 3A, FIG. 3A specifically describes an audio data processing apparatus provided in Embodiment 3 of this application. The audio data processing apparatus may include:

one or more memories; and one or more processors, where the one or more memories stores one or more instruction modules, and the one or more instruction modules are configured to be performed by the one or more processors; and the one or more instruction modules include:

a first obtaining module 10, a second obtaining module 20, a separation module 30, an adjustment module 40, a calculation module 50, and a processing module 60.

1. First Obtaining Module 10

The first obtaining module 10 is configured to obtain to-be-separated audio data.

In this embodiment, the to-be-separated audio data mainly includes an audio file including a voice and an accompaniment sound, for example, a song, a segment of a song, or an audio file recorded by a user, and is usually represented as a time-domain signal, for example, may be a dual-channel time-domain signal.

Specifically, when a user stores a new to-be-separated audio file in a server or when a server detects that a designated database stores a to-be-separated audio file, the first obtaining module 10 may obtain the to-be-separated audio file.

2. Second Obtaining Module 20

The second obtaining module 20 is configured to obtain an overall spectrum of the to-be-separated audio data.

For example, the second obtaining module 20 may be specifically configured to:

perform mathematical transformation on the to-be-separated audio data, to obtain the overall spectrum.

In this embodiment, the overall spectrum may be represented as a frequency-domain signal. The mathematical transformation may be STFT. The STFT transform is related to Fourier transform, and is used to determine a frequency and a phase of a sine wave of a partial region of a time-domain signal, that is, convert a time-domain signal into a frequency-domain signal. After STFT is performed on the to-be-separated audio data, an STFT spectrum diagram is obtained. The STFT spectrum diagram is a graph formed by using the converted overall spectrum according to a voice strength characteristic.

It should be understood that because in this embodiment, the to-be-separated audio data mainly is a dual-channel time-domain signal, the converted overall spectrum should also be a dual-channel frequency-domain signal. For example, the overall spectrum may include a left-channel overall spectrum and a right-channel overall spectrum.

3. Separation Module 30

The separation module 30 is configured to separate the overall spectrum, to obtain a separated singing voice spectrum and a separated accompaniment spectrum, where the singing voice spectrum includes a spectrum corresponding to a singing part of a musical composition, and the accompaniment spectrum includes a spectrum corresponding to an accompaniment part of the musical composition.

In this embodiment, the musical composition mainly includes a song, the singing part of the musical composition mainly is a voice, and the accompaniment part of the musical composition mainly is a sound of an instrument. Specifically, the overall spectrum may be separated by using a preset algorithm. The preset algorithm may be determined according to requirements of an actual application. For example, in this embodiment, the preset algorithm may use a part of algorithm in a related art ADRess method, and may be specifically as follows:

1. It is assumed that an overall spectrum of a current frame includes a left-channel overall spectrum Lf(k) and a right-channel overall spectrum Rf(k), where k is a band index. The separation module 30 separately calculates Azimugram of a right channel and Azimugram of a left channel, and details are as follows:

the Azimugram of the right channel is $AZ_R(k,i)=|Lf(k)-g(i)*Rf(k)|$; and the Azimugram of the left channel is $AZ_L(k,i)=|Rf(k)-g(i)*Lf(k)|$.

g(i) is a scale factor, g(i)=i/b, 0≤i≤b, b is an azimuth resolution, i is an index, and Azimugram represents a degree to which a frequency component in a $k^{th}$ band is cancelled under the scale factor g(i).

2. For each band, a scale factor having a highest cancellation degree is selected to adjust Azimugram:

if $AZ_R(k,i)=\min(AZ_R(k))$, $AZ_R(k,i)=\max(AZ_R(k))-\min(AZ_R(k))$;

otherwise, $AZ_R(k,i)=0$; and correspondingly, the separation module 30 may calculate $AZ_L(k, i)$ by using the same method.

3. For the adjusted Azimugram in step 2, because strengths of a voice on the left and right channels are similar, the voice is in a location in which i is relatively large in the Azimugram, that is, a location in which g(i) approaches 1. If a parameter subspace width H is given, a separated singing voice spectrum on the right channel is estimated as $$V_R(k) = \sum_{i=b-H}^{i=b} AZ_R(k, i),$$

and a separated accompaniment spectrum on the right channel is estimated as $$M_R(k) = \sum_{i=0}^{i=b-H-1} AZ_R(k, i).$$

Correspondingly, the separation module 30 may obtain a separated singing voice spectrum $V_L(k)$ and a separated accompaniment spectrum $M_L(k)$ on the left channel by using the same method, and details are not described herein again.

4. Adjustment Module 40

The adjustment module 40 is configured to adjust the overall spectrum according to the separated singing voice spectrum and the separated accompaniment spectrum, to obtain an initial singing voice spectrum and an initial accompaniment spectrum.

In this embodiment, to ensure a dual-channel effect of a signal output by using the ADRess method, a mask further is calculated according to a separation result of the overall spectrum, and the overall spectrum is adjusted by using the mask, to obtain a final initial singing voice spectrum and initial accompaniment spectrum that have a better dual-channel effect.

For example, the adjustment module 40 may be specifically configured to:

calculate a singing voice binary mask according to the separated singing voice spectrum and the separated accompaniment spectrum; and adjust the overall spectrum by using the singing voice binary mask, to obtain the initial singing voice spectrum and the initial accompaniment spectrum.

In this embodiment, the overall spectrum includes a right-channel overall spectrum Rf(k) and a left-channel overall spectrum Lf(k). Because both the separated singing voice spectrum and the separated accompaniment spectrum are dual-channel frequency-domain signals, the singing voice binary mask calculated by the separation module 40 according to the separated singing voice spectrum and the separated accompaniment spectrum correspondingly includes $Mask_R(k)$ corresponding to the left channel and $Mask_L(k)$ corresponding to the right channel.

For the right channel, a method for calculating a singing voice binary mask $Mask_R(k)$ may be: if $V_R(k)\geq M_R(k)$, $Mask_R(k)=1$, or otherwise, $Mask_R(k)=0$. Subsequently. Rf(k) is adjusted, to obtain the adjusted initial singing voice spectrum $V_R(k)'=Rf(k)*Mask_R(k)$, and the adjusted initial accompaniment spectrum $M_R(k)'=Rf(k)*(1-Mask_R(k))$.

Correspondingly, for the left channel, the adjustment module 40 may obtain the corresponding singing voice binary mask $Mask_L(k)$, initial singing voice spectrum $V_L(k)'$, and initial accompaniment spectrum $M_L(k)'$ by using the same method, and details are not described herein again.

It should be supplemented that because when a related art ADRess method is used for processing, an output signal is a time-domain signal, a related art ADRess system frame needs to be used. The adjustment module 40 may perform ISTFT on the adjusted overall spectrum after the step of "adjusting the overall spectrum by using the singing voice binary mask", to output initial singing voice data and initial accompaniment data. That is, a whole process of the existing ADRess method is completed. Subsequently, the adjustment module 40 performs STFT transform on the initial singing voice data and the initial accompaniment data that are obtained after the transform, to obtain the initial singing voice spectrum and the initial accompaniment spectrum.

5. Calculation Module 50

The calculation module 50 is configured to calculate an accompaniment binary mask of the to-be-separated audio data according to the to-be-separated audio data.

For example, the calculation module 50 may specifically include an analysis submodule 51 and a second calculation submodule 52.

The analysis submodule 51 is configured to perform ICA on the to-be-separated audio data, to obtain analyzed singing voice data and analyzed accompaniment data.

In this embodiment, an ICA method is a typical method for studying BSS. In this method, the to-be-separated audio data (which mainly is a dual-channel time-domain signal) may be separated into an independent singing voice signal and an independent accompaniment signal, and a main assumption is that components in a hybrid signal are non-Gaussian signals and independent statistics collection is performed on the components. A calculation formula may be approximately as follows:

$$U=Was.$$

where s denotes the to-be-separated audio data, A denotes a hybrid matrix, W denotes an inverse matrix of A, the output signal U includes $U_1$ and $U_2$, $U_1$ denotes the analyzed singing voice data, and $U_2$ denotes the analyzed accompaniment data.

It should be noted that because the signal U output by using the ICA method are two unordered mono time-domain signals, and it is not clarified which signal is $U_1$ and which signal is $U_2$, the analysis submodule 41 may further perform relevance analysis on the output signal U and an original signal (that is, the to-be-separated audio data), use a signal having a high relevance coefficient as $U_1$, and use a signal having a low relevance coefficient as $U_2$.

The second calculation submodule 52 is configured to calculate the accompaniment binary mask according to the analyzed singing voice data and the analyzed accompaniment data.

It is easily understood that because both the analyzed singing voice data and the analyzed accompaniment data that are output by using the ICA method are mono time-domain signals, there is only one accompaniment binary mask calculated by the second calculation submodule 52 according to the analyzed singing voice data and the analyzed accompaniment data, and the accompaniment binary mask may be applied to the left channel and the right channel at the same time.

For example, the second calculation submodule 52 may be specifically configured to:

perform mathematical transformation on the analyzed singing voice data and the analyzed accompaniment data, to obtain a corresponding analyzed singing voice spectrum and analyzed accompaniment spectrum: and calculate the accompaniment binary mask according to the analyzed singing voice spectrum and the analyzed accompaniment spectrum.

In this embodiment, the mathematical transformation may be STFT transform, and is used to convert a time-domain signal into a frequency-domain signal. It is easily understood that because both the analyzed singing voice data and the analyzed accompaniment data that are output by using the ICA method are mono time-domain signals, there is only one accompaniment binary mask calculated by the second calculation submodule 52, and the accompaniment binary mask may be applied to the left channel and the right channel at the same time.

Further, the second calculation submodule 52 may be specifically configured to:

perform a comparison analysis on the analyzed singing voice spectrum and the analyzed accompaniment spectrum, and obtain a comparison result; and calculate the accompaniment binary mask according to the comparison result.

In this embodiment, the method for calculating, by the second calculation submodule 52, the accompaniment binary mask is similar to the method for calculating, by the adjustment module 40, the singing voice binary mask. Specifically, assuming that the analyzed singing voice spectrum is $V_U(k)$, the analyzed accompaniment spectrum is $M_U(k)$, and the accompaniment binary mask is $Mask_U(k)$, the method for calculating $Mask_U(k)$ may be:

$$\text{if } M_U(k) \geq V_U(k),\ Mask_U(k)=1;\ \text{if } M_U(k) < V_U(k),\ Mask_U(k)=0.$$

6. Processing Module 60

The processing module 60 is configured to process the initial singing voice spectrum and the initial accompaniment spectrum by using the accompaniment binary mask, to obtain target accompaniment data and target singing voice data.

For example, the processing module 60 may specifically include a filtration submodule 61, a first calculation submodule 62, and an inverse transformation submodule 63.

The filtration submodule 61 is configured to filter the initial singing voice spectrum by using the accompaniment binary mask, to obtain a target singing voice spectrum and an accompaniment subspectrum.

In this embodiment, because the initial singing voice spectrum is a dual-channel frequency-domain signal, that is, includes an initial singing voice spectrum $V_R(k)'$ corresponding to the right channel and an initial singing voice spectrum $V_L(k)'$ corresponding to the left channel, if the filtration submodule 61 imposes the accompaniment binary mask $Mask_U(k)$ to the initial singing voice spectrum, the obtained target singing voice spectrum and the obtained accompaniment subspectrum should also be dual-channel frequency-domain signals.

For example, using the right channel as an example, the filtration submodule 61 may be specifically configured to:

multiply the initial singing voice spectrum by the accompaniment binary mask, to obtain the accompaniment subspectrum; and subtract the accompaniment subspectrum from the initial singing voice spectrum, to obtain the target singing voice spectrum.

In this embodiment, assuming that an accompaniment subspectrum corresponding to the right channel is $M_{R1}(k)$, and a target singing voice spectrum corresponding to the right channel is $V_{Rtarget}(k)$, $M_{R1}(k)=V_R(k)'*Mask_U(k)$, that is, $M_{R1}(k)=Rf(k)*Mask_R(k)*Mask_U(k)$, and $V_{Rtarget}(k)=V_R(k)'-M_{R1}(k)=Rf(k)*Mask_R(k)*(1-Mask_U(k))$.

The first calculation submodule 62 is configured to perform calculation by using the accompaniment subspectrum and the initial accompaniment spectrum, to obtain a target accompaniment spectrum.

For example, using the right channel as an example, the first calculation submodule 62 may be specifically configured to:

add the accompaniment subspectrum and the initial accompaniment spectrum, to obtain the target accompaniment spectrum.

In this embodiment, assuming that a target accompaniment spectrum corresponding to the right channel is $M_{Rtarget}(k)$, $M_{Rtarget}(k)=M_R(k)'+M_{R1}(k)=Rf(k)*(1-Mask_R(k))+Rf(k)*Mask_R(k)*Mask_U(k)$.

In addition, it should be emphasized that related calculation performed by the filtration submodule 61 and the first calculation submodule 62 are merely described by using the right channel as an example, and the filtration submodule 61 and the first calculation submodule 62 further need to perform same calculation for the left channel. Details are not described herein again.

The inverse transformation submodule 63 is configured to perform mathematical transformation on the target singing voice spectrum and the target accompaniment spectrum, to obtain the corresponding target accompaniment data and target singing voice data.

In this embodiment, the mathematical transformation may be ISTFT transform, and is used to convert a frequency-domain signal into a time-domain signal. In some embodiments, after obtaining dual-channel target accompaniment data and target singing voice data, the inverse transformation submodule 63 may further process the target accompaniment data and the target singing voice data, for example, may deliver the target accompaniment data and the target singing voice data to a network server bound to the server, and a user may obtain the target accompaniment data and the target singing voice data from the network server by using an application installed in or a web page screen in a terminal device.

During specific implementation, the units may be implemented as independent entities, or may be combined in any form and implemented as a same entity or a plurality of entities. For specific implementation of the units, refer to the method embodiments described above, and details are not described herein again.

As may be learned from the above, in the audio data processing apparatus provided in this embodiment, the first obtaining module 10 obtains the to-be-separated audio data, the second obtaining module 20 obtains the overall spectrum of the to-be-separated audio data, the separation module 30 separates the overall spectrum, to obtain the separated singing voice spectrum and the separated accompaniment spectrum, and the adjustment module 40 adjusts the overall spectrum according to the separated singing voice spectrum and the separated accompaniment spectrum, to obtain the initial singing voice spectrum and the initial accompaniment spectrum. Meanwhile, the calculation module 50 calculates the accompaniment binary mask according to the to-be-separated audio data. Finally, the processing module 60 processes the initial singing voice spectrum and the initial accompaniment spectrum by using the accompaniment binary mask, to obtain the target accompaniment data and the target singing voice data. Because in this solution, after the initial singing voice spectrum and the initial accompaniment spectrum are obtained according to the to-be-separated audio data, the processing module 60 may further adjust the initial singing voice spectrum and the initial accompaniment spectrum according to the accompaniment binary mask, the separation accuracy may be improved greatly compared with a related art solution. Therefore, accompaniment and a singing voice may be separated from a song completely, so that not only the distortion degree may be reduced greatly, but also mass production of accompaniment may be implemented, and the processing efficiency is high.

Embodiment 4

Correspondingly, this embodiment of this application further provides an audio data processing system, including any audio data processing apparatus provided in the embodiments of this application. For the audio data processing apparatus, refer to Embodiment 3.

The audio data processing apparatus may be specifically integrated into a server, for example, applied to a separation server of WeSing (karaoke software developed by Tencent). For example, details may be as follows:

The server is configured to obtain to-be-separated audio data; obtain an overall spectrum of the to-be-separated audio data: separate the overall spectrum to obtain a separated singing voice spectrum and a separated accompaniment spectrum, where the singing voice spectrum includes a spectrum corresponding to a singing part of a musical composition, and the accompaniment spectrum includes a spectrum corresponding to an accompaniment part of the musical composition; adjust the overall spectrum according to the separated singing voice spectrum and the separated accompaniment spectrum, to obtain an initial singing voice spectrum and an initial accompaniment spectrum; calculate an accompaniment binary mask of the to-be-separated audio data according to the to-be-separated audio data; and process the initial singing voice spectrum and the initial accompaniment spectrum by using the accompaniment binary mask, to obtain target accompaniment data and target singing voice data.

In some embodiments, the audio data processing system may further include another device, for example, a terminal. Details are as follows:

The terminal may be configured to obtain the target accompaniment data and the target singing voice data from the server.

For specific implementation of the devices, refer to the foregoing embodiments, and details are not described herein again.

Because the audio data processing system may include any audio data processing apparatus provided in the embodiments of this application, the audio data processing system may implement beneficial effects that may be implemented by any audio data processing apparatus provided in the embodiments of this application. For the beneficial effects, refer to the foregoing embodiments, and details are not described herein again.

Embodiment 5

Figure 4:
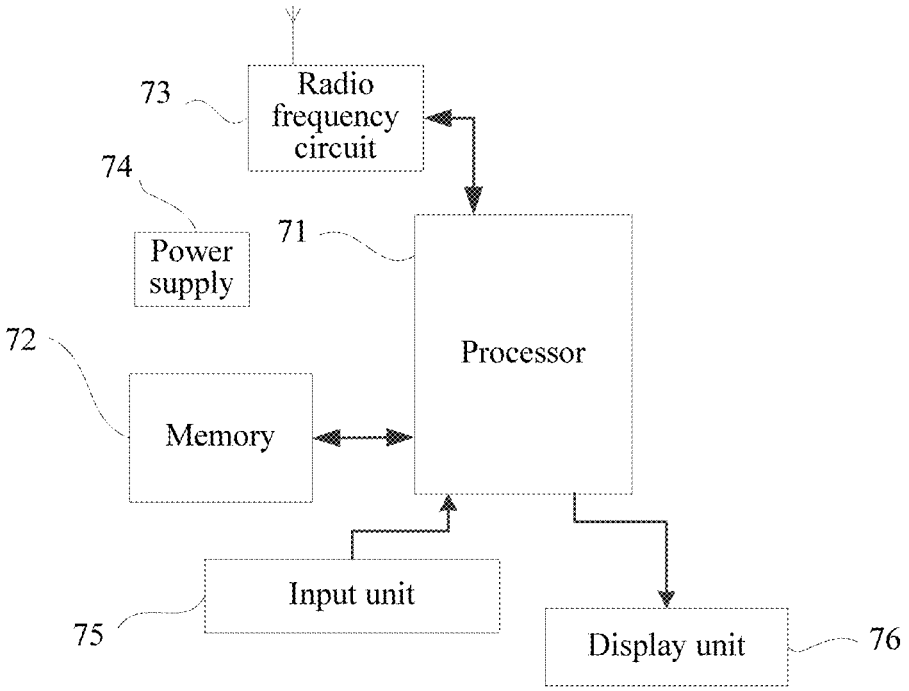
FIG. 4 is a schematic structural diagram of a server according to an embodiment of this application.

This embodiment of this application further provides a server. The server may be integrated into any audio data processing apparatus provided in the embodiments of this application. As shown in FIG. 4. FIG. 4 is a schematic structural diagram of the server used in this embodiment of this application. Specifically:

The server may include a processor 71 having one or more processing cores, a memory 72 having one or more computer readable storage mediums, a radio frequency (RF) circuit 73, a power supply 74, an input unit 75, a display unit 76, and the like. A person skilled in the art may understand that the structure of the server shown in FIG. 4 does not constitute a limitation to the server, and may include more or fewer components than those shown in the figure, or some components may be combined, or different component arrangements may be used.

The processor 71 is a control center of the server, is connected to various parts of the server by using various interfaces and lines, and performs various functions of the server and processes data by running or executing a software program and/or module stored in the memory 72, and invoking data stored in the memory 72, to perform overall monitoring on the server. In some embodiments, the processor 71 may include one or more processing cores. The processor 71 may integrate an application processor and a modem processor. The application processor mainly processes an operating system, a user interface, an application program, and the like. The modem processor mainly processes wireless communication. It may be understood that the foregoing modem processor may also not be integrated into the processor 71.

The memory 72 may be configured to store a software program and module. The processor 71 runs the software program and module stored in the memory 72, to implement various functional applications and data processing. The memory 72 mainly may include a program storage region and a data storage region. The program storage region may store an operating system, an application required by at least one function (for example, a voice playback function, or an image playback function), and the like, and the data storage region may store data created according to use of the server, and the like. In addition, the memory 72 may include a high speed random access memory (RAM), and may also include a non-volatile memory, such as at least one magnetic disk storage device, a flash memory, or another volatile solidstate storage device. Correspondingly, the memory 72 may further include a memory controller, so that the processor 71 accesses the memory 72.

The RF circuit 73 may be configured to receive and send signals in an information receiving and transmitting process. Especially, after receiving downlink information of a base station, the RF circuit 73 delivers the downlink information to the one or more processors 71 for processing, and in addition, sends related uplink data to the base station. Generally, the RF circuit 73 includes, but is not limited to, an antenna, at least one amplifier, a tuner, one or more oscillators, a subscriber identity module (SIM) card, a transceiver, a coupler, a low noise amplifier (LNA), and a duplexer. In addition, the RF circuit 73 may also communicate with a network and another device by means of wireless communication. The wireless communication may use any communication standard or protocol, which includes, but is not limited to, Global System for Mobile communications (GSM), General Packet Radio Service (GPRS), Code Division Multiple Access (CDMA), Wideband Code Division Multiple Access (WCDMA), Long Term Evolution (LTE), e-mail. Short Messaging Service (SMS), and the like.

The server further includes the power supply 74 (such as a battery) for supplying power to the components. The power supply 74 may be logically connected to the processor 71 by using a power management system, thereby implementing functions such as charging, discharging, and power consumption management by using the power management system. The power supply 74 may further include one or more of a direct current or alternating current power supply, a re-charging system, a power failure detection circuit, a power supply converter or inverter, a power supply state indicator, and any other components.

The server may further include the input unit 75. The input unit 75 may be configured to receive input digit or character information, and generate a keyboard, mouse, joystick, optical, or track ball signal input related to user settings and functional control. Specifically, in a specific embodiment, the input unit 75 may include a touch-sensitive surface and another input device. The touch-sensitive surface, which may also be referred to as a touch screen or a touch panel, may collect a touch operation of a user on or near the touch-sensitive surface (such as an operation of a user on or near the touch-sensitive surface by using any suitable object or accessory such as a finger or a stylus), and drive a corresponding connection apparatus according to a preset program. In some embodiments, the touch-sensitive surface may include a touch detection apparatus and a touch controller. The touch detection apparatus detects a touch position of the user, detects a signal generated by the touch operation, and transfers the signal to the touch controller. The touch controller receives the touch information from the touch detection apparatus, converts the touch information into touch point coordinates, and sends the touch point coordinates to the processor 71. Moreover, the touch controller may receive and execute a command sent from the processor 71. In addition, the touch-sensitive surface may be a resistive, capacitive, infrared, or surface sound wave type touch-sensitive surface. In addition to the touch-sensitive surface, the input unit 75 may further include another input device. Specifically, the another input device may include, but is not limited to, one or more of a physical keyboard, a functional key (such as a volume control key or a switch key), a track ball, a mouse, and a joystick.

The server may further include a display unit 76. The display unit 76 may be configured to display information input by the user or information provided for the user, and various graphical interfaces of the server. The graphical interfaces may be formed by a graphic, a text, an icon, a video, and any combination thereof. The display unit 76 may include a display panel, and in some embodiments, the display panel may be configured in a form of a liquid crystal display (LCD), an organic light-emitting diode (OLED), or the like. Further, the touch-sensitive surface may cover the display panel. After detecting a touch operation on or near the touch-sensitive surface, the touch-sensitive surface transfers the touch operation to the processor 71, so as to determine a type of the touch event. Then, the processor 71 provides a corresponding visual output on the display panel according to the type of the touch event. Although in FIG. 4, the touch-sensitive surface and the display panel are used as two separate parts to implement input and output functions, in some embodiments, the touch-sensitive surface and the display panel may be integrated to implement the input and output functions.

Although not shown in the figure, the server may further include a camera, a Bluetooth module, and the like, and details are not described herein. Specifically, in this embodiment, the processor 71 in the server loads executable files corresponding to processes of the one or more applications to the memory 72 according to the following instructions, and the processor 71 runs the application in the memory 72, to implement various functions. Details are as follows:

obtaining to-be-separated audio data;

obtaining an overall spectrum of the to-be-separated audio data;

separating the overall spectrum, to obtain a separated singing voice spectrum and a separated accompaniment spectrum, where the singing voice spectrum includes a spectrum corresponding to a singing part of a musical composition, and the accompaniment spectrum includes a spectrum corresponding to an accompaniment part of the musical composition;

adjusting the overall spectrum according to the separated singing voice spectrum and the separated accompaniment spectrum, to obtain an initial singing voice spectrum and an initial accompaniment spectrum;

calculating an accompaniment binary mask according to the to-be-separated audio data; and processing the initial singing voice spectrum and the initial accompaniment spectrum by using the accompaniment binary mask, to obtain target accompaniment data and target singing voice data.

For an implementation method of the foregoing operations, refer to the foregoing embodiments specifically, and details are not described herein again.

As may be learned from the above, the server provided in this embodiment may obtain the to-be-separated audio data, obtain the overall spectrum of the to-be-separated audio data, separate the overall spectrum to obtain the separated singing voice spectrum and the separated accompaniment spectrum, and adjust the overall spectrum according to the separated singing voice spectrum and the separated accompaniment spectrum, to obtain the initial singing voice spectrum and the initial accompaniment spectrum. Meanwhile, the server calculates the accompaniment binary mask according to the to-be-separated audio data, and finally, processes the initial singing voice spectrum and the initial accompaniment spectrum by using the accompaniment binary mask, to obtain the target accompaniment data and the target singing voice data, so that accompaniment and a singing voice may be separated from a song completely, greatly improving the separation accuracy, reducing the distortion degree, and improving the processing efficiency.

A person of ordinary skill in the art may understand that all or some of the steps of the methods in the embodiments may be implemented by a program instructing relevant hardware. The program may be stored in a computer readable storage medium. The storage medium may include a read-only memory (ROM), a RAM, a magnetic disk, and an optical disc.

In addition, this embodiment of this application further provides a computer readable storage medium. The computer readable storage medium stores a computer readable instruction, so that the at least one processor performs the method in any one of the foregoing embodiments, for example:

obtaining to-be-separated audio data;

obtaining an overall spectrum of the to-be-separated audio data;

separating the overall spectrum, to obtain a singing voice spectrum and an accompaniment spectrum;

calculating an accompaniment binary mask of the to-be-separated audio data according to the to-be-separated audio data; and processing the singing voice spectrum and the accompaniment spectrum by using the accompaniment binary mask, to obtain accompaniment data and singing voice data.

The audio data processing method, apparatus, and system that are provided in the embodiments of this application are described in detail above. The principle and implementation of this application are described herein by using specific examples. The description about the embodiments is merely provided to help understand the method and core ideas of this application. In addition, a person skilled in the art may make variations and modifications in terms of the specific implementations and application scopes according to the ideas of this application. Therefore, the content of this specification shall not be construed as a limitation to this application or to the appended claims.

What is claimed is:

1. A method comprising:

obtaining audio data;

obtaining an overall spectrum of the audio data;

separating the overall spectrum into a first singing voice spectrum and a first accompaniment spectrum;

adjusting the overall spectrum according to the first singing voice spectrum and the first accompaniment spectrum, to obtain a second singing voice spectrum and a second accompaniment spectrum;

calculating an accompaniment binary mask of the audio data according to the audio data; and processing the second singing voice spectrum and the second accompaniment spectrum using the accompaniment binary mask, to obtain accompaniment data and singing voice data.

2. The method according to claim 1, wherein the processing the second singing voice spectrum and the second accompaniment spectrum comprises:

filtering the second singing voice spectrum using the accompaniment binary mask, to obtain a third singing voice spectrum and an accompaniment subspectrum;

performing calculation using the accompaniment subspectrum and the second accompaniment spectrum, to obtain a third accompaniment spectrum; and performing mathematical transformation on the third singing voice spectrum and the third accompaniment spectrum, to obtain the accompaniment data and singing voice data.

3. The method according to claim 2, wherein the filtering comprises:

multiplying the second singing voice spectrum by the accompaniment binary mask, to obtain the accompaniment subspectrum; and subtracting the accompaniment subspectrum from the second singing voice spectrum, to obtain the third singing voice spectrum.

4. The method according to claim 2, wherein the performing calculation comprises:

adding the accompaniment subspectrum and the second accompaniment spectrum, to obtain the third accompaniment spectrum.

5. The method according to claim 1, wherein the adjusting comprises:

calculating a singing voice binary mask according to the first singing voice spectrum and the first accompaniment spectrum; and adjusting the overall spectrum by using the singing voice binary mask, to obtain the second singing voice spectrum and the second accompaniment spectrum.

6. The method according to claim 1, wherein the calculating comprises:

performing independent component analysis (ICA) on the audio data, to obtain first singing voice data and first accompaniment data; and calculating the accompaniment binary mask according to the first singing voice data and the first accompaniment data, wherein the singing voice spectrum and the accompaniment spectrum are processed using the accompaniment binary mask, to obtain second accompaniment data and second singing voice data.

7. The method according to claim 6, wherein the calculating the accompaniment binary mask according to the first singing voice data and the first accompaniment data comprises:

performing mathematical transformation on the first singing voice data and the first accompaniment data, to obtain a corresponding fourth singing voice spectrum and fourth accompaniment spectrum; and calculating the accompaniment binary mask according to the fourth singing voice spectrum and the fourth accompaniment spectrum.

8. An apparatus comprising:

at least one memory configured to store computer program code; and at least one processor configured to access the at least one memory and operate according to the computer program code, the computer program code including:

first obtaining code configured to cause the at least one processor to obtain audio data;

second obtaining code configured to cause the at least one processor to obtain an overall spectrum of the audio data;

separation code configured to cause the at least one processor to separate the overall spectrum, to obtain a first singing voice spectrum and a first accompaniment spectrum;

adjustment code configured to cause the at least one processor to adjust the overall spectrum according to the first singing voice spectrum and the first accompaniment spectrum, to obtain a second singing voice spectrum and a second accompaniment spectrum calculation code configured to cause the at least one processor to calculate an accompaniment binary mask of the audio data according to the audio data; and processing code configured to cause the at least one processor to process the second singing voice spectrum and the second accompaniment spectrum using the accompaniment binary mask, to obtain accompaniment data and singing voice data.

9. The apparatus according claim 8, wherein the processing code comprises:

filtration subcode configured to cause the at least one processor to filter the second singing voice spectrum using the accompaniment binary mask, to obtain a third singing voice spectrum and an accompaniment subspectrum;

first calculation subcode configured to cause the at least one processor to perform calculation using the accompaniment subspectrum and the second accompaniment spectrum, to obtain a third accompaniment spectrum; and inverse transformation subcode configured to cause the at least one processor to perform mathematical transformation on the third singing voice spectrum and the third accompaniment spectrum, to obtain the accompaniment data and singing voice data.

10. The apparatus according to claim 9, wherein the filtration submodule is configured to cause the at least one processor to:

multiply the second singing voice spectrum by the accompaniment binary mask, to obtain the accompaniment subspectrum; and subtract the accompaniment subspectrum from the second singing voice spectrum, to obtain the third singing voice spectrum; and the first calculation submodule is configured to cause the at least one processor to add the accompaniment subspectrum and the second accompaniment spectrum, to obtain the third accompaniment spectrum.

11. The apparatus according to claim 8, wherein the adjustment code is configured to cause the at least one processor to:

calculate a singing voice binary mask according to the first singing voice spectrum and the first accompaniment spectrum; and adjust the overall spectrum by using the singing voice binary mask, to obtain the first singing voice spectrum and the first accompaniment spectrum.

12. The apparatus according to claim 8, wherein the calculation code comprises:

analysis subcode configured to cause the at least one processor to perform independent component analysis (ICA) on the audio data, to obtain first singing voice data and first accompaniment data; and second calculation subcode configured to cause the at least one processor to calculate the accompaniment binary mask according to the first singing voice data and the first accompaniment data, wherein the processing code is configured to cause the at least one processor to process the singing voice spectrum and the accompaniment spectrum using the accompaniment binary mask, to obtain second accompaniment data and second singing voice data.

13. The apparatus according to claim 12, wherein the second calculation submodule is configured to cause the at least one processor to:

perform mathematical transformation on the first singing voice data and the first accompaniment data, to obtain a corresponding fourth singing voice spectrum and fourth accompaniment spectrum; and calculate the accompaniment binary mask according to the fourth singing voice spectrum and the fourth accompaniment spectrum.

14. A method comprising:

separating audio data into a singing voice spectrum and an accompaniment spectrum using an Azimuth Discrimination and Resynthesis (ADRess) method;

adjusting an overall spectrum of the audio data according to the singing voice spectrum and the accompaniment spectrum, to obtain an adjusted singing voice spectrum and an adjusted accompaniment spectrum;

calculating an accompaniment binary mask from the audio data; and processing the adjusted singing voice spectrum and the adjusted accompaniment spectrum using the accompaniment binary mask, to obtain accompaniment data and singing voice data.

15. The method according to claim 14, wherein the adjusting comprises:

calculating a singing voice binary mask according to the singing voice spectrum and the accompaniment spectrum, wherein the overall spectrum is adjusted using the singing voice binary mask to obtain the adjusted signing voice spectrum and the adjusted accompaniment spectrum.

16. The method according to claim 14, wherein the calculating comprises:

performing independent component analysis (ICA) on the audio data, to obtain initial singing voice data and initial accompaniment data; and calculating the accompaniment binary mask according to the initial signing voice data and the initial accompaniment data.

17. The method according to claim 16, wherein the calculating the accompaniment binary mask according to the initial singing voice data and the initial accompaniment data comprises:

performing mathematical transformation on the initial singing voice data and the initial accompaniment data, to obtain a transformed singing voice spectrum and a transformed accompaniment spectrum; and calculating the accompaniment binary mask according to the transformed singing voice spectrum and the transformed accompaniment spectrum.

* * * * *